United States Patent [19]

Mitchell

[11] Patent Number: 4,780,665

[45] Date of Patent: Oct. 25, 1988

[54] APPARATUS AND METHOD FOR CONTROLLING SAND MOISTURE

[75] Inventor: Wade S. Mitchell, Buckingham, Iowa

[73] Assignee: Deere & Company, Moline, Ill.

[21] Appl. No.: 913,197

[22] Filed: Sep. 30, 1986

[51] Int. Cl.[4] ..... G01R 27/02

[52] U.S. Cl. ..... 324/65 R; 366/8; 366/160; 164/4.1; 164/456; 364/550

[58] Field of Search ..... 324/65 R; 364/550; 366/3-8, 160, 154, 162; 164/4.1, 456

[56] References Cited

U.S. PATENT DOCUMENTS

| | | | |
|---|---|---|---|
| 3,376,877 | 4/1968 | Fegan, Jr. | 324/65 R |
| 3,497,803 | 2/1970 | Fegan, Jr. | 324/65 R |
| 3,500,187 | 3/1970 | Fegan, Jr. | 324/65 R |
| 4,251,759 | 2/1981 | Boldt | 318/449 |
| 4,304,289 | 12/1981 | McMullen | 164/154 |
| 4,616,425 | 10/1986 | Burns | 324/65 R |

*Primary Examiner*—A. D. Pellinen
*Assistant Examiner*—H. L. Williams

[57] ABSTRACT

An apparatus for controlling the moisture content of sand as it is transported from storage to a mold making apparatus. A conveyor is used to transport a substantially uniform layer of sand at a known rate. The electrical resistance across the sand layer is measured using a series of electrically conductive members that extend into the sand. A thermocouple or other contact device is used to obtain an average temperature of the sand layer. The electrical resistance and average temperature measurements are used in a signal processor to calculate a starting moisture content for the sand. The signal processing unit also calculates an amount of water that should be added to the sand to achieve a computed moisture content value. The signal processing unit further controls the means for adding the water to the sand so that the computed moisture content value is obtained.

8 Claims, 4 Drawing Sheets

APPARATUS AND METHOD FOR CONTROLLING SAND MOISTURE

BACKGROUND OF THE INVENTION

1. Field of the Invention

This invention relates to methods for preparing foundry sand and more particularly to a method for automatically controlling the moisture content of foundry sand.

2. Description of the Prior Art

In foundry operations, foundry sand is mixed with water and used for molds and cores which are in turn used in casting operations. Moisture control is known to be an important factor in obtaining durable molds and cores. It is known to measure the moisture content of foundry sand prior to mixing the sand in a mixer in order to calculate the volume of water that should be added to obtain the correct moisture content. An example of such a system is U.S. Pat. No. 4,569,025 which teaches the automatic measurement of sand moisture content along with other foundry sand parameters. The measurement of moisture content can take place in the mixer or as the sand is transported to the mixer.

A system of the latter type is known wherein the moisture content of sand is calculated by measuring the loss of microwave energy through the sand and the temperature of the sand. In this apparatus, a layer of sand is conveyed from a hopper to a mixer along a belt. Microwave energy and infrared temperature measurements are taken as the sand is moved along the belt. Based on these readings and assuming a constant belt speed, a volumetric addition of water is automatically calculated, using an analog circuit, and added to the sand after it enters the hopper. Although the infrared temperature sensors and microwave measurements give precise information on sand temperature and moisture content, these methods suffer from restricted sampling area and therefore often lead to wide deviations between the actual and desired sand moisture content. In addition, the volumetric rate of sand transport often varies from its predicted rate therefore leading to additional variations between the actual moisture content of sand leaving the mixer and the desired moisture content of the sand.

SUMMARY OF THE INVENTION

Accordingly, it is a broad object of this invention to provide an improved apparatus for automatically measuring the moisture content of sand and adding a controlled amount of water to adjust the moisture content of the sand.

Another object of this invention is to provide an apparatus for controlling the moisture content of sand that will allow the sand moisture content to be kept within a desired moisture content range.

A further object of this invention is to provide an apparatus having sensors that will improve the automatic moisture content control of foundry sand.

Yet another object of this invention is to provide a method for automatically controlling the moisture content of foundry sand so that the moisture content of the sand is kept within a desired range.

In brief summary, one or more of these objects are achieved by an apparatus for controlling the moisture content of sand which uses a conveyor for transporting a substantially uniform layer of sand. With the conveyor there is provided a means for measuring the average temperature of the sand layer across its width and generating a representative temperature signal. Along with the temperature measurement means, a series of electrically conductive members extend into and are spaced transversely across at least a portion of the sand layer to measure the electrical resistance across the sand layer between the members. Means are also provided for measuring the velocity of the sand layer that moves past the temperature measurement means and the conductive members. The temperature signal and signals representing the electrical resistance and velocity of the sand layer are received by a signal processing unit into which a predetermined moisture content value is stored and which calculates a water addition value that is necessary for the sand to have the predetermined moisture content. The water addition valve is used to control a means for adding water to the sand that is located downstream of the temperature measuring means and the resistance members.

In a highly desired form, this invention uses thermocouples as the sensor for measuring sand temperature and a series of plates mounted transversely to the directional movement of the sand layer to measure electrical resistance across the sand that passes between the plates. Accuracy of the temperature measurement across the sand layer is improved by using a series of thermocouples located at different depths within the sand layer. It has also been found that the temperature on the surface of the sand layer is often much lower than the temperature of sand in the middle or bottom of the sand layer. Therefore, taking the temperature reading at several depths in the sand layer gives a more representative value of the average sand temperature. It has also been found that the moisture content of the sand can vary over the layer. Therefore, measurement of incipient sand moisture content is improved by the use of plates for measuring the electrical resistance since the plates may be spaced apart and inserted into the sand layer to measure a relatively large volume of sand and thereby obtain a more accurate value for average resistance which in turn allows calculation of a more reliable value for the overall sand moisture content. In this regard, it has been found that two plates spaced apart transversely with respect to the direction of sand flow and placed with their longitudinal dimension parallel to the direction of sand flow, which are inserted into sand layer by an amount sufficient to measure at least ten percent of the volume of sand passing by the plates will provide a satisfactory resistance reading for calculating and controlling the sand moisture content.

As stated earlier, transportation of the sand using a belt conveyor has been found to introduce errors in the measurement of the passing sand volume. This error is introduced by assuming that the rate of sand transport remains constant and is proportional to the speed of the motor driving the belt. On the typical belt conveyor, that is used to transport the sand, slippage occurs between the drive roller and the belt which prevents the motor speed of the driven roller from providing an accurate indication of sand layer velocity. In this apparatus, the sand layer velocity is measured by monitoring actual sand layer or belt speed.

The apparatus of this invention also uses a signal processing unit to continually calculate the required water addition that will provide the sand with a computed water content that represents the desired water content at some later stage. The later stage is usually when sand is withdrawn from the mixer and put in a casting mold. The signal processing unit uses at least the electrical resistance of the sand to gauge its moisture content and can be further programmed to include sand temperature and sand composition parameters in the calculation of sand moisture content. Another water addition value is then calculated, using the sand temperature, to determine an amount of additional sand moisture that will allow for evaporative losses between the time of resistance sensing and the final use of the sand in the casting mold and provide additional moisture content to the sand as the sand temperature increases. A higher moisture content is necessary at higher sand temperatures to give the sand proper molding properties. In order to increase the flexibility of control, the signal processing unit can be a programmable microprocessor for storing empirical coefficients and constants that refine the calculation of sand moisture content and water addition requirements.

Finally, the addition of water to the sand is controlled by a valve having multiple positioning capability and which, in response to a signal representing the water addition value, will regulate the flow rate accordingly. The valve may be calibrated to fully position itself in response to an appropriate signal from the signal processing unit or a flow monitor may be used in conjunction with the valve and the valve repetitively incremented or decremented until the measured flow rate matches the water input value.

In another aspect, this invention is directed to a method of controlling the moisture content of sand as it passes from a supply point to a delivery point. In this method, sand is transported from the supply to the delivery point in a relatively uniform layer and the speed at which the layer passes is monitored. As transport continues, the temperature of the passing sand and its electrical resistance are measured. The temperature of the passing sand is measured at at least two distinct locations of differing depths across the width of the layer to provide an average sand temperature. On the basis of transport speed, sand layer temperature and electrical resistance the amount of water addition necessary to achieve a desired moisture content of the sand is calculated. Water, in the calculated amount, is then added to the sand downstream, with respect to the direction of sand travel, from the location of sand temperature and electrical resistance measurement.

Additional advantages, features and details of this invention will become apparent from following drawings and detailed description.

DESCRIPTION OF THE PREFERRED EMBODIMENT

Figure 1:
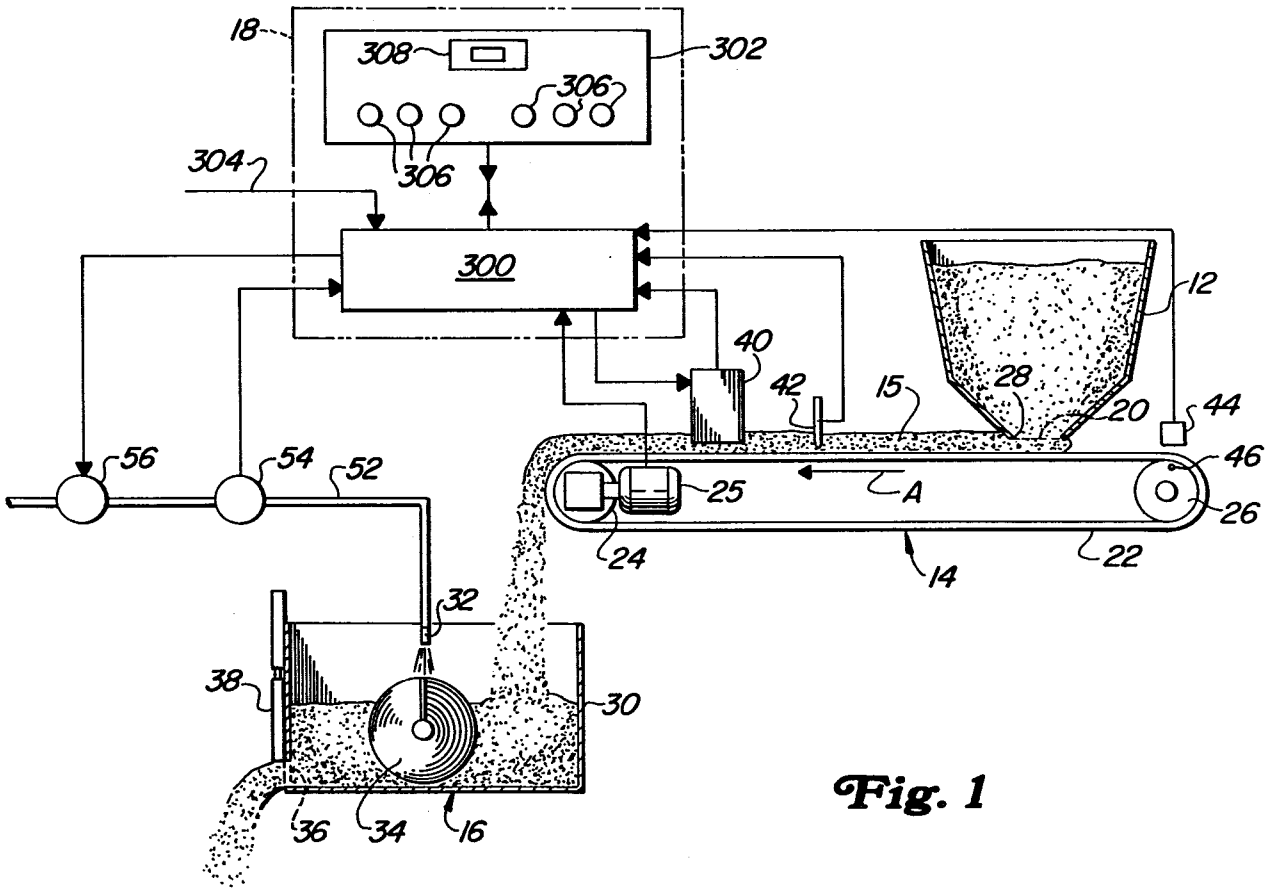
FIG. 1 is a schematic diagram of an apparatus arranged in accordance with this invention.

A sand mixing system arranged in accordance with this invention is shown schematically in FIG. 1. Sand is emptied from a hopper 12 onto a conveyor 14 and emptied into a mixer 16. Water is added to the mixture in a quantity regulated by a signal processing unit 18.

The conveyor 14 and sand hopper 12 cooperate to deposit and transfer a uniform layer of sand 15 along the conveyor and into mixer 16. An inventory of foundry sand is maintained in hopper 12. Sand from hopper 12 is channeled through an opening 20 at the bottom of the hopper and directed onto a belt 22. Belt 22 is driven in direction A by frictional engagement with a head roller 24. A variable speed motor 25 drives head roller 24 through an appropriate gearing mechanism. Belt 22 is continuous and loops around head roller 24 and a tail roller 26, with both rollers acting in opposition to maintain a desired amount of tension on the belt. As the belt moves in direction A, sand is carried away from opening 20 and under a striker edge 28. Striker edge 28 maintains sand layer 15 at a depth of sixteen and one-half inches. As sand layer 15 advances over head roller 24, it drops off belt 22 and into mixer 16.

Mixer 16 collects sand from the belt, mixes water with the sand to adjust its moisture content and allows sand to be withdrawn at a controlled rate for use in molds or forms. In simplified form the mixer consists of a containment vessel 30, a nozzle 32 through which water is directed into the mixer and a wheel and plow assembly 34 for mixing the sand and water. Sand is withdrawn through an opening 36 at one end of the mixer. A movable door assembly 38 regulates the withdrawal of the sand and water mixture from the hopper, with the withdrawal of sand being intermittent or continuous. A motor assembly (not shown) drives muller wheels 34 as water from a high pressure supply (not shown) is piped to nozzle 32 by a conduit 52 and directed into the mixer at a volumetric rate determined by the hereinafter described signal processing unit.

Signal processing unit 18 has three basic functions: receiving measurments of the physical properties of sand entering the mixture; using these physical properties to calculate the necessary water addition to the mixer to achieve a desired sand moisture content; and delivering a control signal for regulating the addition of water to the mixer, so that water is supplied in the required amount. The signal processing unit monitors and controls the sand moisture content through a series of electrical signals. These signals are generated or received by sensors and electro-mechanical control devices located about the system.

Figure 2:
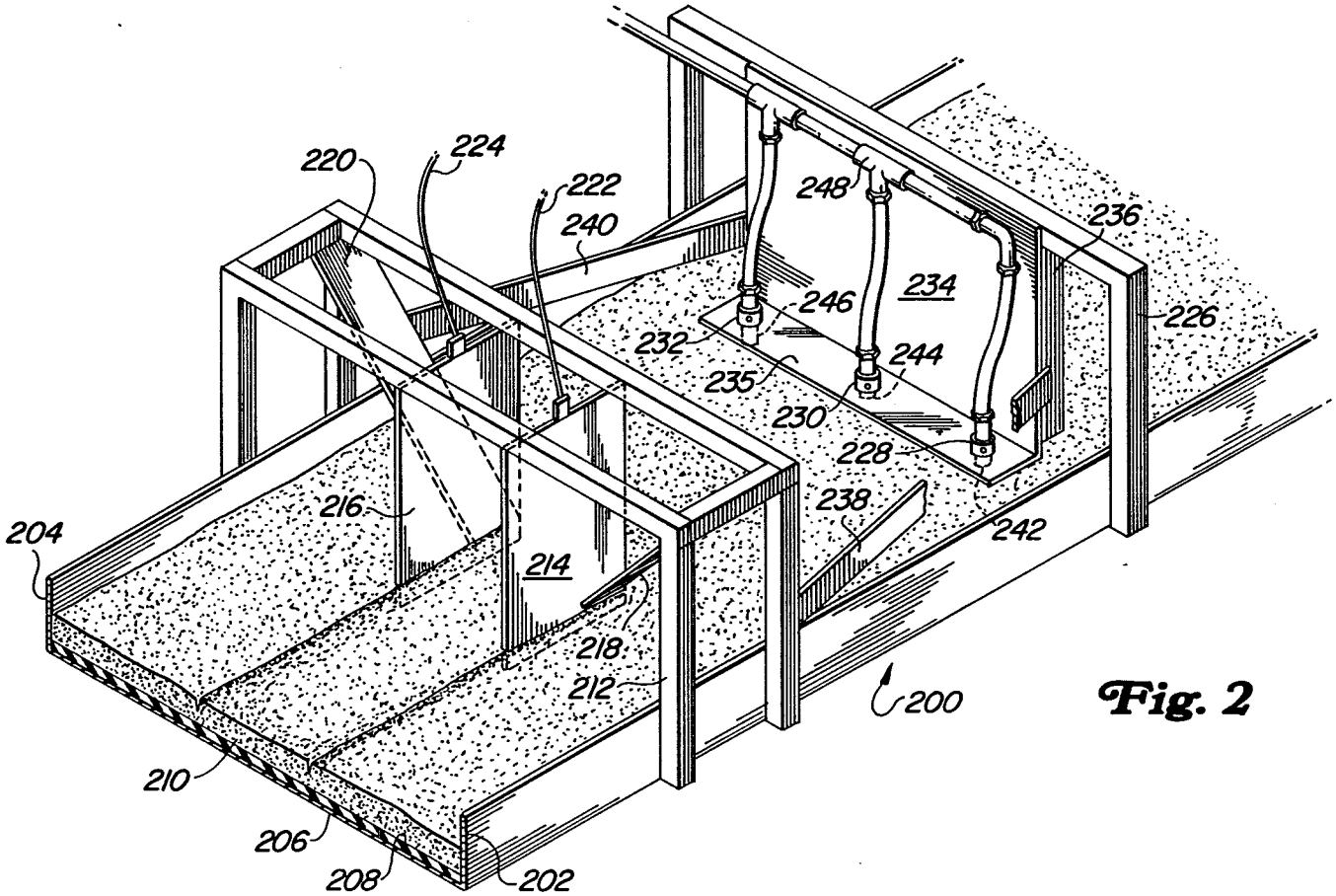
FIG. 2 is an isometric view looking at a section of a conveyor shown schematically in FIG. 1.

Signals indicative of the sand properties are obtained from sensors 40 that measure the electrical resistance of the sand and sensors 42 that measure sand temperature. FIG. 2 shows a section 200 of conveyor 14 over which sensors 40 and 42 are located. Conveyor section 200 consists of side members 202 and 204 which are welded together about a support member 206 to define a conveyor channel. A segment 208 of belt 22 slides on top of support plate 206 and extends across support plate 206 to about the edges of side plates 202 and 204. A sand layer 210 rests on top of belt 208 for movement therewith. The width of the sand layer is controlled by side plates 202 and 204, which maintain the sand layer at a relatively uniform width of thirty-seven inches. A support frame 212, attached to the outside of side plates 202 and 204, spans the top of sand layer 210. Sensors 40 consist of two rectangular steel plates 214, 216 which are suspended from support frame 212 and extend approximately ten inches into sand layer 210. Plates 214 and 216 are spaced six inches apart and have a width of eleven inches. A set of lateral supports 218 and 220 prevent transverse movement of plates 214 and 216 respectively. Each support 218, 220 is welded to an outer face of its associated plate, outer being taken to mean away from the center of the sand layer, and an upper corner of support frame 212. A power supply cable 222 is conductingly attached to the top edge of plate 214. A power output cable 224 is conductingly attached to the top edge of plate 216. The opposite ends of power cables 222 and 224 are connected to signal processing unit 18 and used, in a manner hereinafter described to establish an electrical circuit across the section of sand layer 210 between plates 214 and 216. Frame 212 is made of a nonconductive material such as wood or plastic to prevent the frame from shorting plates 214 and 216. Thus, at any given time, the plates 214 and 216 will act to measure the resistance of the volume of sand passing therebetween, this volume being equal to the product of the plate width, plate depth of insertion and the spacing between the plates. Using the dimensions stated above, it can be seen that the plates 214 and 216 act to measure the resistance of approximately ten percent of the total volume of sand passing by the plates.

Ahead of frame 212, a support structure 226 is attached to the outsides of side plates 202 and 204 and suspends sensors 42, over the sand layer. Sensors 42 comprise a set of three contact thermocouples 228, 230, 232. A flange 235 is positioned parallel to the sand layer and has three thermocouples secured thereto. Flange 235 is part of folded plate 234 which extends upward and is attached to the top of support structure 226. A backing plate 236 extends downward from the top of support structure 226 to stiffen support plate 234. Frame 212 and structure 226 are spaced close together so that sensors 40 and 42 are separated by less than the width of belt segment 208. A pair of stabilizer bars 238 and 240 extend from opposite sides of frame 212 and to opposite sides of plate 234. The stabilizer bars reduce deflection of the thermocouples under the drag loading of the passing sand layer. The probe ends of thermocouples 228, 230 and 232 are shown by dashed lines 242, 244 and 246, respectively. As shown by the drawings, these probe ends have different lengths so that they extend to different depths within the sand layer. A cable and conduit arrangement 248 connects the thermocouples with the signal processing unit 18.

A sensor, positioned adjacent tail roller 26, measures the speed of the sand layer by monitoring the belt speed. This sensor consists of a proximity switch 44 located slightly above tail roller 26 to sense the passing of a probe 46 located on the periphery of tail roller 26. Therefore, revolutions of the tail roller which has a diameter of eighteen inches are monitored to obtain a belt speed input. Monitoring the revolutions of tail roller 26 provides an accurate measurement of the belt speed since there is negligible slip between belt 22 and tail roller 26. A signal indicating the time for one revolution of the tail roller is obtained from proximity switch 44 and received by signal processing unit 18.

Signal processing unit 18 also monitors the flow rate of water through conduit 52. A turbine type flow meter 54 positioned across conduit 52 sends an electrical signal indicative of the flow rate to signal processing unit 18. Signal processing unit 18, in a manner hereinafter described, generates a water control signal indicating whether flow to nozzle 32 should be increased or decreased. A control valve 56 is positioned across conduit 52 and receives the water control signal. Control valve 56 is a solenoid operated electro mechanical flow control valve.

Looking in more detail at the signal processing unit, this can consist of any electronic data processing system that is capable of receiving electronic signals from the sensors and sending electronic signals to the control device. In this embodiment the signal processing unit consists of a standardized industrial controller 300 that interfaces with an operator panel 302.

Controller 300 is a PLC 2/30 made by Allen Bradley. A series of input/output modules are included with the controller for converting and scaling analog signals that enter the controller into digital form and digital signals leaving the controller into analog form. The controller 300 has a remote power supply 304 for providing the necessary power for the sensors and control devices. In particular, controller 300 delivers a 6.57 volt supply to the conductive plates and uses a 0–20 milliamp sensor to measure the amperage across the plates of sensor 40. Electrical signals from flow recorder 54, motor 25, thermocouples 42 and proximity switch 44 are also received by controller 300. The signals are processed within the controller which generates and sends the water output signal to control valve 56. Controller 300 executes a set of program steps, as hereinafter described, to generate the signal for control valve 56. In addition, controller 300 performs a series of data checks on the signals from the various signals. The controller receives additional input for performing the calculations and transmits data check information to control panel 302.

Control panel 302 contains a series of warning lights 306 and a thumbwheel control 308. When one of the signals, checked by controller 300, is out of tolerance, a corresponding warning light on control panel 302 is energized. The thumbwheel control 308 is positioned by the operator to send an digital reference signal to the controller corresponding to a predetermined sand moisture content that ultimately controls are moisture content of the sand in the mixer.

Figure 3A:
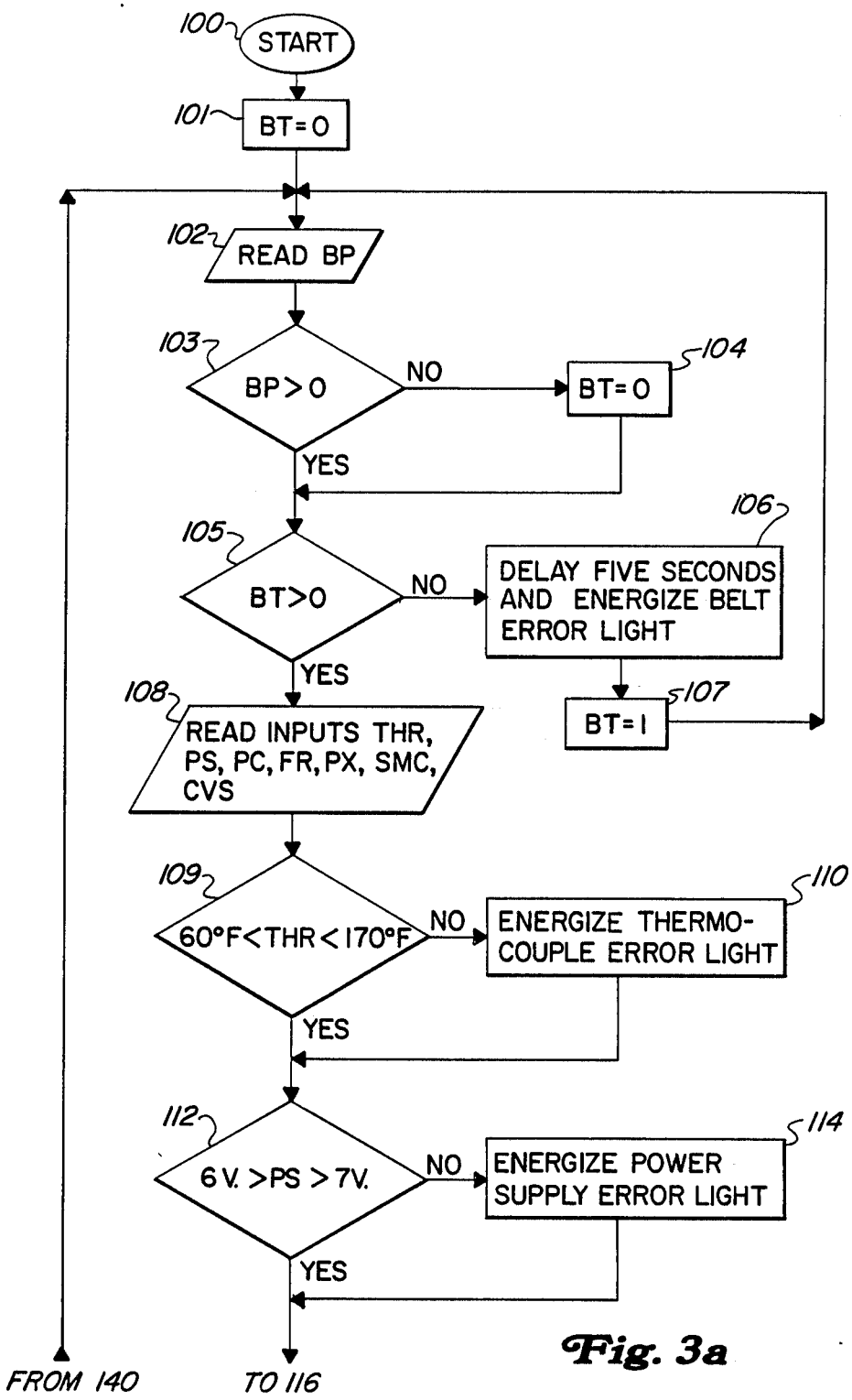
FIG. 3 is a flow chart showing an algorithm for the computations performed by the signal processing unit.
Figure 3B:
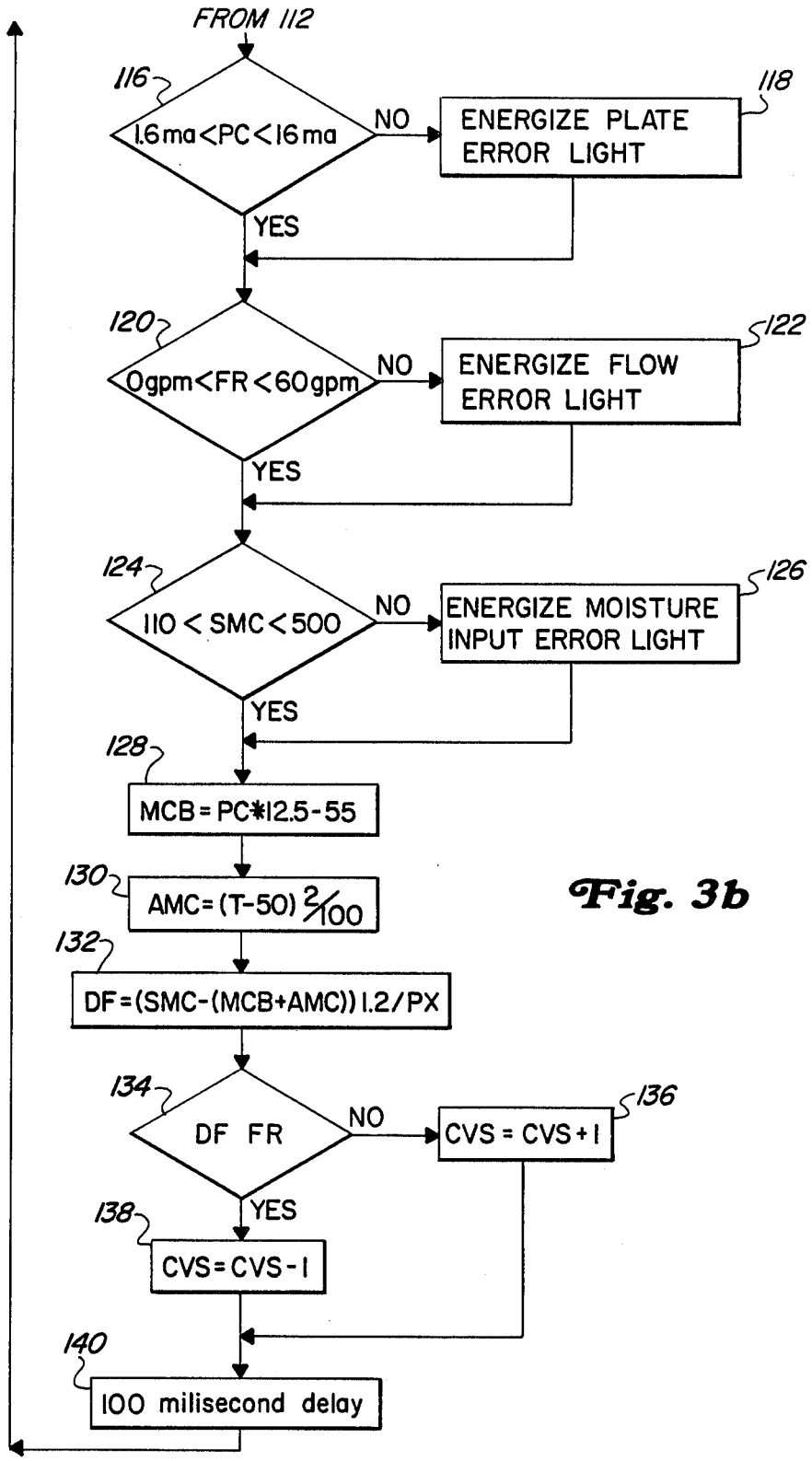

The program steps or algorithim executed by controller 300 are set forth in flow chart form in FIGS. 3*a* and 3*b*. Acronyms for the various input and output signals, which appear throughout the specification and flow chart have the following definitions:

BP=signal indicating that motor 25 is running
THR=thermocouple signal representing average sand temperature in degrees Fahrenheit
PS=signal indicating input voltage to plates 40
PC=signal corresponding to output current from sensor 40 in milliamperes
FR=flow rate of water input from meter 54
PX=input from proximity switch which is equal to the time in seconds for each revolution of tail roller 26
SMC=value obtained from thumbwheel which is scaled to equal 100 times the selected moisture content percentage
CVS=signal to control valve.

The algorithim begins with step 100. In step 101, BT, which is used to monitor the belt operation, is assigned a value of zero. At step 102, BP is read to determine if motor 25 is running and more generally if the system is on. An input module of controller 300 assigns BP a value of zero when the belt power is off and a value greater than zero when belt power is on. Step 103 checks whether the power is being supplied to the belt. If not, BT is again initialized to zero in step 104. Decision step 105 transfers the sequence to steps 106 if BT is not greater than zero. Step 106 uses an appropriate timing device to delay the program for five seconds and generates a signal for energizing a warning light in step 106. The warning light remains lit during the five second delay period to indicate that the belt is not running. The five second interval is used at this point to give the belt and sand layer enough time to reach steady state after the system is initially turned on. After five seconds BT is assigned a value of one in statement 107 and the program returns to 102 to again check if the belt is running. Once the belt has run for at least five seconds, BT retains a value greater than one and the program goes from step 105 to step 108.

Sensor inputs THR, PS, FR, PX and SMC are read in step 108. The sensor inputs are then checked in the succeeding series of steps for out of tolerance values. In step 109, THR, is checked to make sure the sand input temperature is between 60° F. and 170° F. PS is checked in step 112 for minimum and maximum values of 6 and 7 volts, respectively. The amperage output value, PC, is checked in step 116 for a reading in the range of 1.6 to 16 milliamps. Flow recorder input FR is checked in step 120 for a value of 0 and 60 gallons per minute. Finally, SMC is checked to see if it is between 110 and 500, which represents a moisture content between 1.1% and 5.0%. If any of inputs THR, PS, PC, FR or SMC are out of tolerance, then steps 110, 114, 118, 122 or 126, respectively, will energize an appropriate warning light in light set 206. Regardless of errors in the input, the program continues on to step 128.

Step 128 uses an empirically derived equation to calculate the moisture content of the sand on the belt, MCB. This equation was empirically derived by sampling the moisture content of sand passing between the plates and plotting the moisture content as a function of the resistance across the plates. The coefficient 12.5 and the constant 55 were used to define a linear function that would approximate the moisture resistance curve. Thus, a similar approach can be used to derive suitable linear coeffients and constants for systems that do not match the belt and sensor geometry of the system described herein. Furthermore, the linear function was used in this embodiment for the sake of simplicity; however, the accuracy of the moisture content calculation may be improved in other applications by the use of a higher order, curve fitting equation. In addition, resistance is influenced by the sand composition and temperature. Therefore, a more general sand moisture equation could be derived having factors or variables for different types of sand and variations in sand temperature. Inclusion of such variables in the equation of step 128 were not necessary for this preferred embodiment since the sand used herein is ordinary foundry green sand and the sand tempeature usually falls in a range of between 80° F. and 160° F.

Another emperically derived equation, set forth in step 130, computes the additional moisture content, AMC, that is necessary to compensate for evaporative losses and provide suitable molding properties at the measured temperature. Again this relationship is emperically derived and based on the specific conveyor-mixer arrangement of this embodiment which allows about ten minutes to elapse between the time that the sand properties are measured and the sand is finally used in the mold. The basic form of the equation in step 130 is a well known relationship for adjusting sand moisture content with temperature to obtain suitable molding properties. It is only the constant, 50 and the coefficient of 1/100 that were adjusted to provide suitable moisture content compensation for the system herein described.

In step 132 the desired flow rate, DF, is calculated by subtracting MCB and AMC from the selected moisture content of the sand, SMC, and dividing the sum by PX to obtain a rate. The coefficient 1.2 in step 132 is based on the geometry of the system herein described and contains the necessary volume and rate factors for converting the moisture content percentage and belt timing values into a gallons per minute value.

In step 134, the desired flow rate is compared with the actual flow rate. If the desired flow rate is less than the actual flow rate, the routine goes to step 136 which decreases the digital count for the control valve signal, CVS. If the desired flow rate is greater than the actual flow rate, the routine goes to step 138 wherein the digital count for the control valve is increased. One of the hereinbefore described modules scales the value of CVS such that a digital value of 200 will generate a signal for fully closing control valve 56 and a digital value of one thousand will generate a signal that fully opens control valve 56.

In step 140, the routine is delayed for a 100 milliseconds by a suitable timing device before returning back to step 102 and continuing the loop. The program then loops from step 140 to step 102 to check that the belt remains running. The delay of 100 milliseconds can be extended for other applications if hunting of the flow control valve becomes a problem.

The flow chart FIGS. 3*a* and 3*b* describes the operation of the program in a general way which can be converted to a machine language and implemented by those skilled in the art. In addition, this description has set forth a specific configuration for the mixer, conveyor and control apparatus. This specific arrangement includes structural details, control system details and operating parameters that may be varied in order to tailor the system of this invention to other applications. For instance, it may be desirable to have the sensed parameters recorded for later retrieval and review. Furthermore, it may be advantageous to replace the control board with a CRT terminal which could display all input and output values. In light of the foregoing description, those skilled in the art will be aware of these and other alternatives, modifications and variations that may be available in practicing this invention. Accordingly, this invention is intended to embrace all such alternatives, modifications and variations which fall within the spirit and scope of the appended claims.

I claim:

1. An apparatus for controlling the moisture content of sand, said apparatus comprising:

a conveyor for transporting a substantially uniform layer of sand of a given width;

means for measuring the temperature of said sand layer at at least two points at different depths across the width of said sand layer and generating a temperature signal representing an average of the temperature measured at said at least two points;

at least two parallel, spaced apart electrically conductive members having respective surfaces confronting each other and extending in the direction of sand transport by a distance of about ten inches and being inserted into said sand layer and being located for having at least ten percent of the sand passing by the members at any time located between the respective surfaces;

means for measuring the electrical resistance of the sand between said members and generating a resistance signal representing the electrical resistance of the sand between said members;

means for measuring the transport velocity of the sand layer and generating a velocity signal representing the velocity of the sand layer;

a signal processing unit including signal generating means for generating a predetermined moisture content reference signal and being coupled for receiving said temperature signal, said resistance signal, and said velocity signal, and for calculating a water addition value representing an amount of water addition that will provide the sand in said layer with said predetermined moisture content; and means for adding water, downstream of the temperature measuring means and said members, to the sand transported in said layer at a rate determined by said water addition value.

2. The apparatus of claim 1 wherein said signal generating means includes operator controllable means for establishing said predetermined moisture content reference signal.

3. The apparatus of claim 1 wherein said electrically conductive members comprise parallel conductive plates that are inserted into the sand layer for at least half the depth of and at transversely spaced locations across the width of the sand layer and are arranged parallel, with respect to the direction of sand transport.

4. The apparatus of claim 1 wherein said conveyor uses a moving belt to transport said sand, said belt having a drive roller and tail roller, and said means for measuring the velocity of the sand layer monitors the angular velocity of said tail roller.

5. The apparatus of claim 1 wherein said means for measuring the temperature of the sand layer comprises a series of three thermocouples positioned at different depths in said sand layer.

6. The apparatus of claim 1 wherein said electrically conductive members are in the form of plates arranged with their width dimension parallel to the direction of sand transport, said plates being spaced apart in a direction transverse to the direction of sand transport and being inserted to a depth in the sand layer such that at least ten percent of the transported sand passing by the plates at any given time is located between the plates.

7. The apparatus of claim 1 where said means for measuring the temperature of said sand layer are spaced apart from said members by a distance, along the direction of sand flow, no greater than the width of said sand layer.

8. A method for controlling the moisture content of sand passing from a supply point to delivery point, said method comprising the steps of:

(a) transporting a relatively uniform layer of sand, having a uniform width, from said supply point to said delivery point;

(b) monitoring the transport speed of said sand layer;

(c) measuring the temperature of said sand layer at two or more different locations of differing depths across the width of said layer;

(d) continuously measuring the electrical resistance across at least ten percent of the sand layer located at any given time, within a zone extending approximately ten inches in the direction of sand transport;

(e) establishing a predetermined sand moisture content value;

(f) using the transport speed, sand layer temperature measurements, and electrical resistance measurements to calculate a water addition rate necessary to bring the moisture content of the transported sand to said predetermined sand moisture content value; and (g) adding water at the calculated addition rate to the sand of said layer at a location downstream, with respect to the direction of sand travel, from the location of sand temperature and electrical resistance measurement.

* * * * *